US008051951B2

(12) United States Patent
Bennett et al.

(10) Patent No.: US 8,051,951 B2
(45) Date of Patent: Nov. 8, 2011

(54) RETRACTABLE ACCESS PLATFORM

(75) Inventors: Ronald W. Bennett, Florence, SC (US); Ellie H. MacDonald, Timmonsville, SC (US)

(73) Assignee: Aluminum Ladder Company, Florence, SC (US)

( * ) Notice: Subject to any disclaimer, the term of this patent is extended or adjusted under 35 U.S.C. 154(b) by 377 days.

(21) Appl. No.: 12/478,265

(22) Filed: Jun. 4, 2009

(65) Prior Publication Data

US 2010/0307868 A1 Dec. 9, 2010

(51) Int. Cl.
*E04G 1/38* (2006.01)

(52) U.S. Cl. ..... 182/39; 182/36; 182/113; 182/62.5; 182/83; 182/130; 182/131; 182/132; 182/65.1; 182/66.2

(58) Field of Classification Search ..... 182/36, 182/39, 113, 62.5, 83, 127, 130–132, 65.1, 182/66.2
See application file for complete search history.

(56) References Cited

U.S. PATENT DOCUMENTS 3,785,454 A * 1/1974 Behunin et al. ..... 182/14
4,232,759 A * 11/1980 Jacobs ..... 182/39
4,630,708 A * 12/1986 Thompson ..... 182/12
4,679,657 A * 7/1987 Bennett et al. ..... 182/113
4,787,111 A * 11/1988 Pacek et al. ..... 14/71.1
5,067,587 A * 11/1991 Mims et al. ..... 182/69.6
5,148,889 A * 9/1992 Fenwick et al. ..... 182/17
5,299,653 A * 4/1994 Nebel ..... 182/2.7
6,186,273 B1 * 2/2001 Goldbach et al. ..... 182/128
6,230,841 B1 * 5/2001 Valore ..... 182/39
6,619,427 B1 * 9/2003 Kerr ..... 182/39
6,848,539 B2 * 2/2005 Lee et al. ..... 182/128
7,004,286 B2 * 2/2006 Fredette ..... 182/62.5
7,140,467 B2 * 11/2006 Cook ..... 182/143
7,216,741 B2 * 5/2007 MacDonald et al. ..... 182/113
7,757,813 B2 * 7/2010 Kerr ..... 182/39
7,832,525 B2 * 11/2010 Bennett et al. ..... 182/36
2003/0168282 A1 * 9/2003 Harris ..... 182/113
2004/0031645 A1 * 2/2004 Sheppard et al. ..... 182/131
2006/0054392 A1 * 3/2006 MacDonald et al. ..... 182/113
2009/0078502 A1 * 3/2009 Knurr ..... 182/13
2011/0036662 A1 * 2/2011 Smith ..... 182/37
2011/0078864 A1 * 4/2011 Bennett ..... 14/71.7

* cited by examiner

*Primary Examiner* — Katherine Mitchell
*Assistant Examiner* — Johnnie A Shablack
(74) *Attorney, Agent, or Firm* — John B. Hardaway, III; Nexsen Pruet, LLC

(57) ABSTRACT

An apparatus for providing access to vehicles and containers on a pair of railways or thoroughfares. The apparatus is comprised of a raised walkway between the pair of thoroughfares having a tracking platform movable thereon. Pivotally attached to and carried by the tracking platform is a turret. Carried on the turret and hinged thereto is a bridge that is rotatable in a vertical plane. At the end of the bridge is a cage pivotally attached to the bridge so that the cage remains horizontal when the bridge is rotated vertically on the turret. The bridge and cage are dimensioned so that, when the turret is rotated such that the bridge is directed between and parallel to the thoroughfares and the bridge and cage are raised, the apparatus is entirely out of the clearance envelopes of the thoroughfares.

20 Claims, 8 Drawing Sheets

RETRACTABLE ACCESS PLATFORM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

The present invention relates generally to access platforms. Access platforms are used to provide access to railcars, trucks, ships, assembly lines, and various vehicles on other thoroughfares. A need exists for an improved access platform that is designed to provide safe access to two adjacent thoroughfares (e.g., railways), be longitudinally adjustable with respect to the thoroughfares, and yet be retractable to avoid intruding into the clearance envelopes of the thoroughfares.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

The present invention can include or be installed upon a raised walkway. The raised walkway is typically positioned between and substantially parallel to the railways or thoroughfares to which the present invention provides access. A tracking platform is carried on the raised walkway and is movable thereon. In one embodiment of the present invention, the tracking platform is movable substantially the entire length of the raised walkway.

A turret is carried on the tracking platform. The turret is able to pivot at least 180 degrees, allowing whatever is carried on the turret to be directed to either of the adjacent thoroughfares individually or between and parallel to the thoroughfares. A bridge is rotatably attached to the turret. The bridge is vertically rotatable between a horizontal position and an upward vertical position. A cage is attached to and extends out from the bridge. The cage is rotatable with respect to the bridge so that, when the bridge is rotated between a horizontal and vertical position, the cage remains horizontal. By raising the bridge when the bridge and cage are positioned between and parallel to the adjacent thoroughfares, the cage can be retracted out of the clearance envelopes of the adjacent thoroughfares.

Other features and advantages of the present invention will be apparent to those skilled in the art from a careful reading of the Detailed Disclosure of Embodiments presented below and accompanied by the drawings.

DETAILED DESCRIPTION OF EMBODIMENTS

As described in summary form above, this invention relates to a retractable access platforms. Although primarily described herein in terms of its use with railcars, it will be clear that the present invention can also be used in connection with any thoroughfare, including roads, canals, assembly lines, or manufacturing lines to provide access to various vehicles, tanks, or manufactured items on the thoroughfares.

Figure 1:
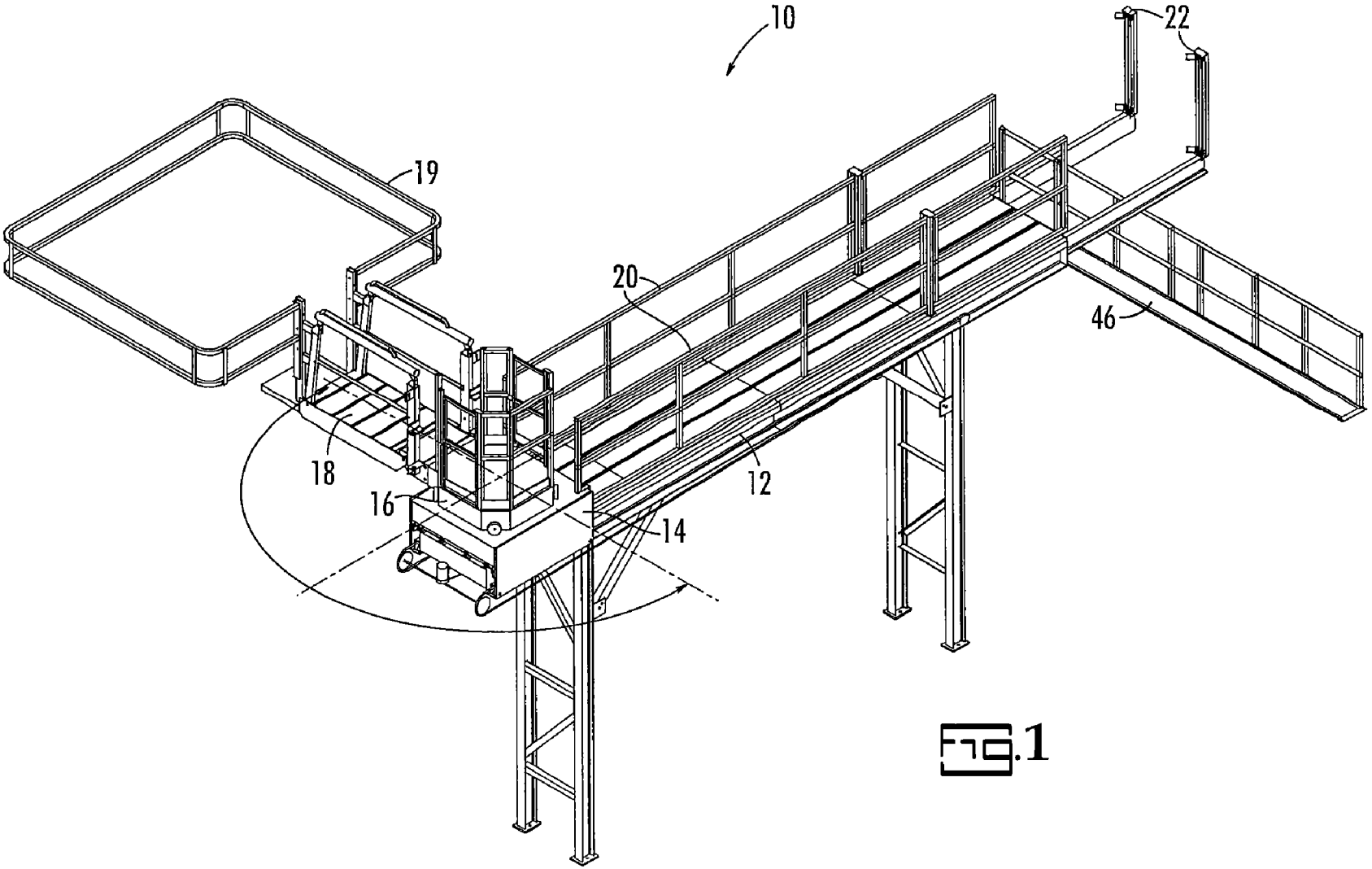
FIG. 1 is a perspective view of the access platform with the cage extended toward one thoroughfare, according to one embodiment of the present invention.

FIG. 1 shows one embodiment of the present invention 10. The apparatus 10 shown in FIG. 1 is typically positioned longitudinally between two adjacent and substantially parallel railway lines (not shown) or other thoroughfares. The primary support structure for the apparatus is a raised walkway 12. Stairway 46 provides access to raised walkway 12. Alternatively, a ladder or elevator could be used to provide access to raised walkway 12. Tracking platform 14 is movably attached to raised walkway 12 and preferably can be moved substantially the entire length of raised walkway 12. Tracking platform 14 carries turret 16. Turret 16 is rotatable on tracking platform 14 so that it can be turned to one side or the other (indicated with the arrow) to afford access to the railway lines or thoroughfares on either side of the raised platform 12.

Figure 2:
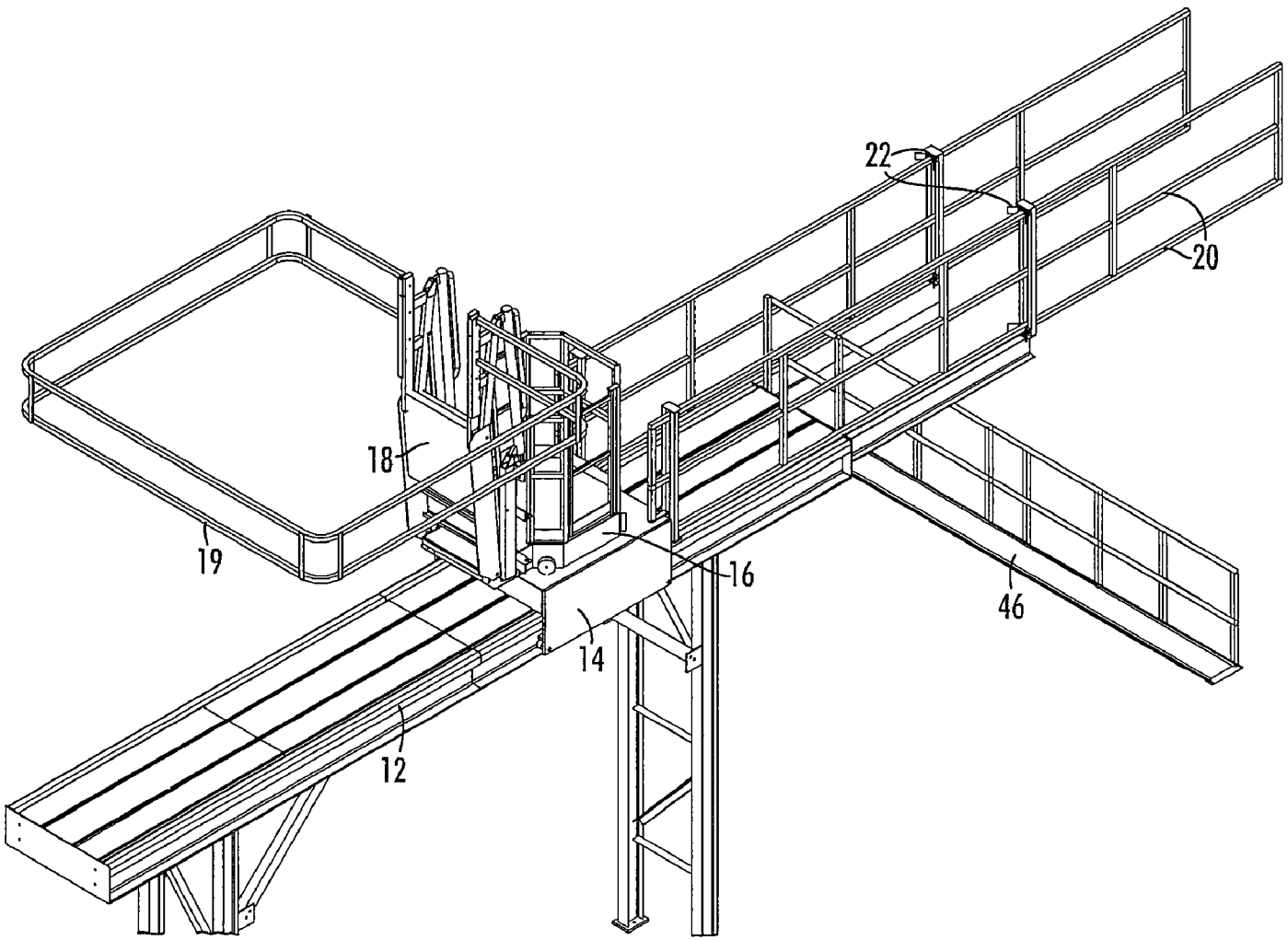
FIG. 2 is a perspective view of the access platform with the cage retracted, according to one embodiment of the present invention.

Turret 16 carries bridge 18, which is rotatably attached to turret 16 so that it can be rotated in a vertical plane from a horizontal position (shown in this figure) to a vertical position (shown in FIG. 2). Cage 19 is carried on bridge 18 and is rotatably attached thereto. Cage 19 is rotatably attached to bridge 18 so that, when bridge 18 is rotated to a vertical position (FIG. 2), cage 19 is retracted and raised but remains horizontal at all times.

Slidably carried on raised walkway 12 are handrails 20. Handrails 20, although slidably carried on raised walkway 12, are fixed to tracking platform 14 so that when tracking platform 14 is moved along raised walkway 12, handrails 20 slide on raised walkway 12 and move with tracking platform 14. Accordingly, when tracking platform 14 moves toward the top of stairway 46, handrails 20 also move in that direction. To ensure that handrails 20 are supported as they move toward (and eventually past) the top of stairway 46, handrails guides 22 can be installed on walkway 12. Handrail guides 22 are positioned and dimensioned to receive handrails 20.

FIG. 2 shows the same embodiment of the present invention 10 with the tracking platform 14 moved close to the top of ladder 46 and with cage 19 and bridge 18 in the retracted position. Note that in the retracted position, the side of turret 16 to which bridge 18 is attached does not face the railways or thoroughfares adjacent to the apparatus 10 but instead is aligned longitudinally parallel to the railways or thoroughfares. Moreover, when cage 19 is in the retracted position, note that it is raised well above the raised walkway 12, unlike when it is in the extended position (FIG. 1), in which case it can be substantially level with raised walkway 12. Also, note the position of handrails 20. Handrails 20, which have moved along with tracking platform 14 toward the top of ladder 46, extend off of the raised walkway 12, through handrails guides 22, and are cantilevered out over ladder 46.

Figure 3:
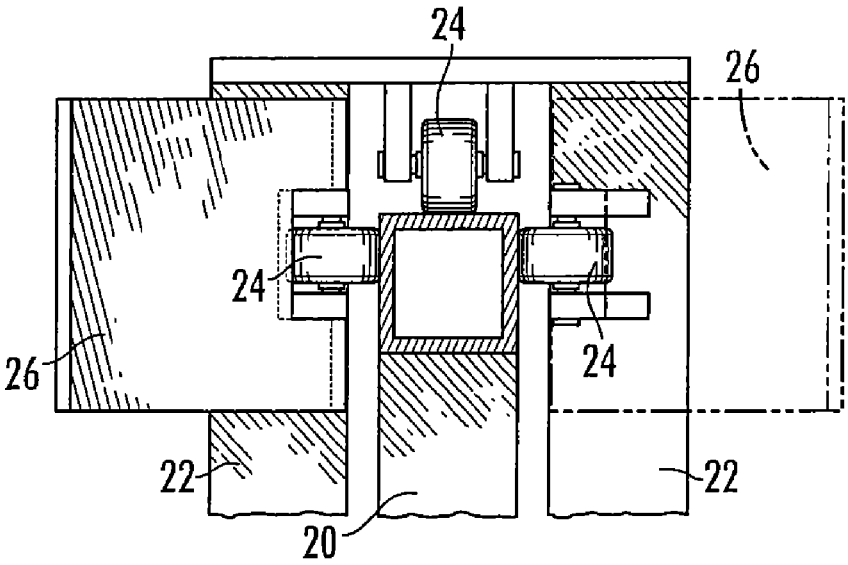
FIG. 3 is a detail view of a walkway handrail (shown partially in cross-section) received in a handrail guide.
Figure 4:
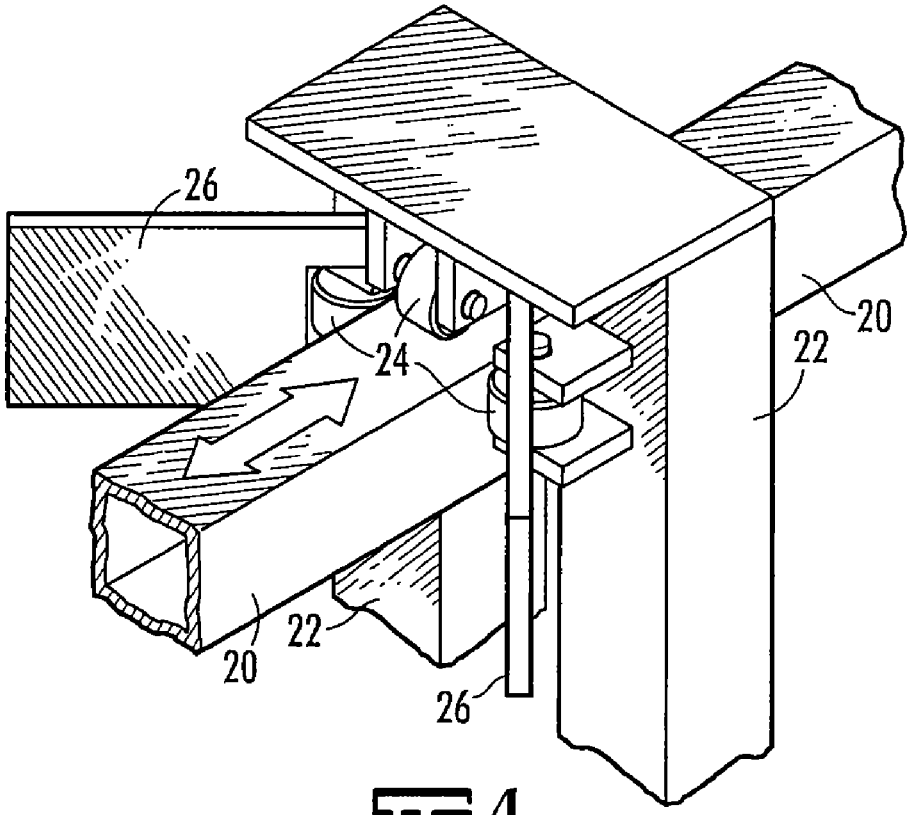
FIG. 4 is a perspective detail view of a walkway handrail (show partially in cross-section) received into a handrail guide.

FIGS. 3 and 4 show detailed views of handrails 20 in handrails guides 22. Note that the handrail guides 22 can be equipped with rollers 24 and funneling tabs 26 (one of which is shown in dot-dash lines). The funneling tabs 26 ensure that the handrail 20 is properly aligned with handrail guide 22 as it approaches and enters the handrails guide 22. The rollers 24 ensure that handrail 20 is able to move freely through handrail guide 22.

Figure 5:
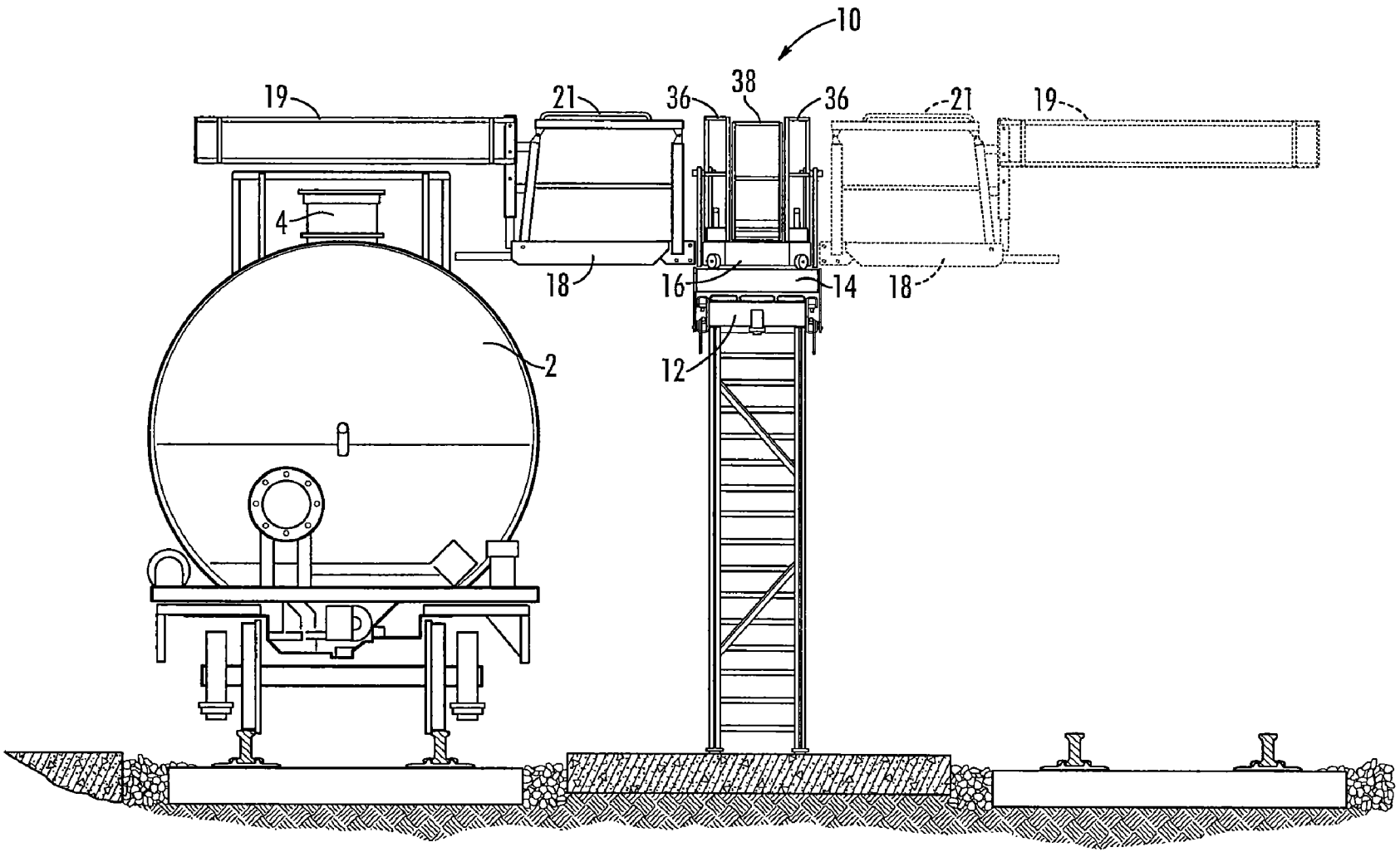
FIG. 5 is a view of the access platform extended to provide access to a railway tank car, according to one embodiment of the present invention.

FIG. 5 shows the apparatus of the present invention 10 extended out over a railroad tank car 2 to provide access to the inlet 4 of the tank car 2. Note that the present invention provides fall protection to the user regardless of whether the user is standing on the raised walkway 12, the turret 16, the bridge 18, or on the tank car 2. This is because the user is always surrounded by a safety railing. While on the raised walkway 12, the user is protected by the handrails 20 (FIGS. 1 and 2). The turret 16 is equipped with fixed handrails 36 and gates 38. For added protection, gates 38 can be self-closing and self-latching. The bridge 18 is equipped with handrails 21. Additionally, when the user is on the tank car 2, the cage 19 provides fall protection.

Referring still to FIG. 5, note that the bridge 18 and cage 19 are also shown (in dashed lines) extended over the adjacent railroad track to illustrate that the turret 16, bridge 18, and cage 19 are all rotatable at least 180 degrees to afford access to both of the adjacent railways. Although railways are shown in FIG. 5, it is to be understood that features of the present invention make it appropriate for providing access to all types of vehicles, containers, and other things being moved along thoroughfares of all types and the present invention should not be limited to railways.

Figure 6:
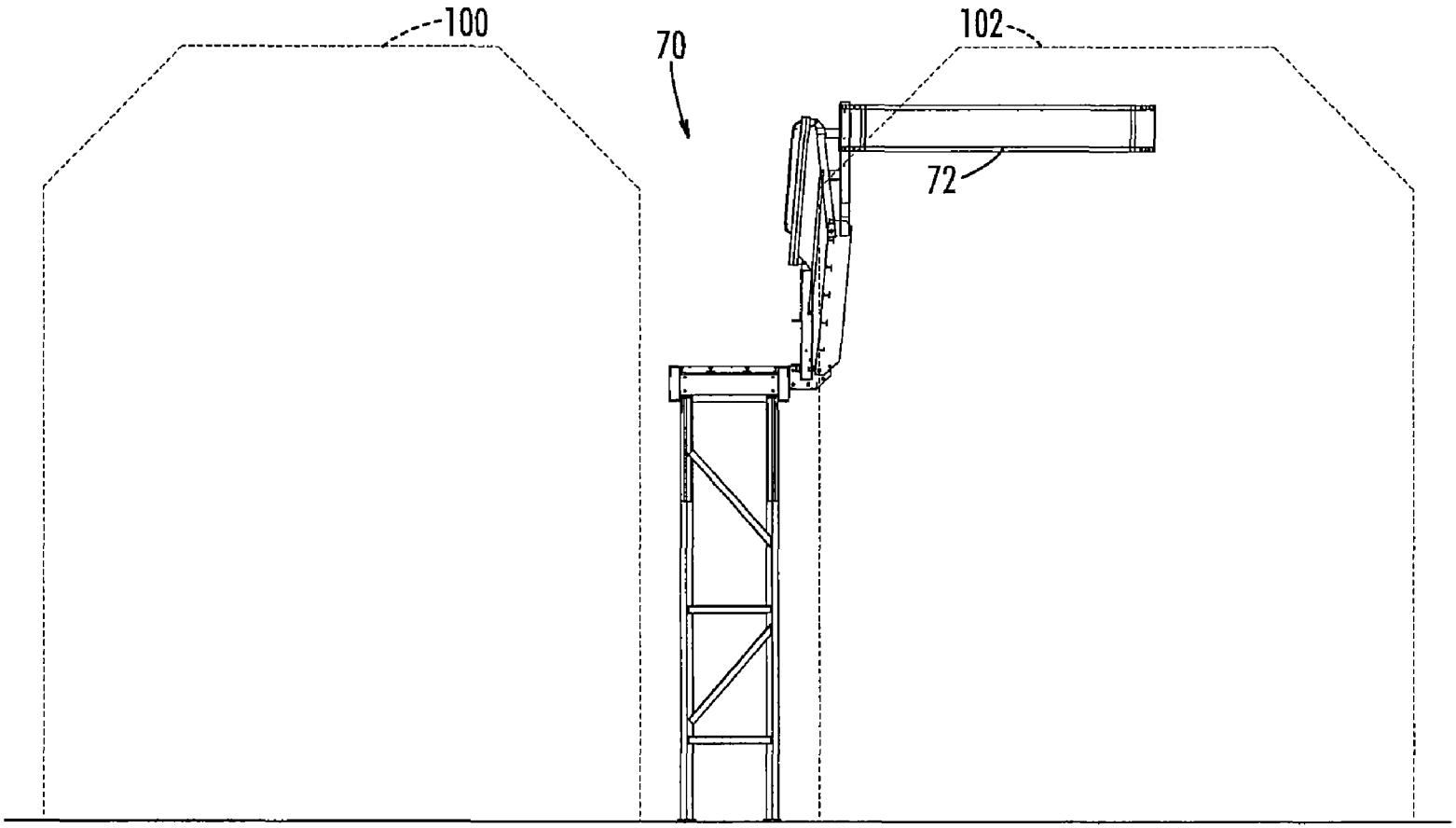
FIG. 6 PRIOR ART
FIG. 6 is a view of the prior art showing that it intrudes into the clearance envelope even when fully retracted.
Figure 7:
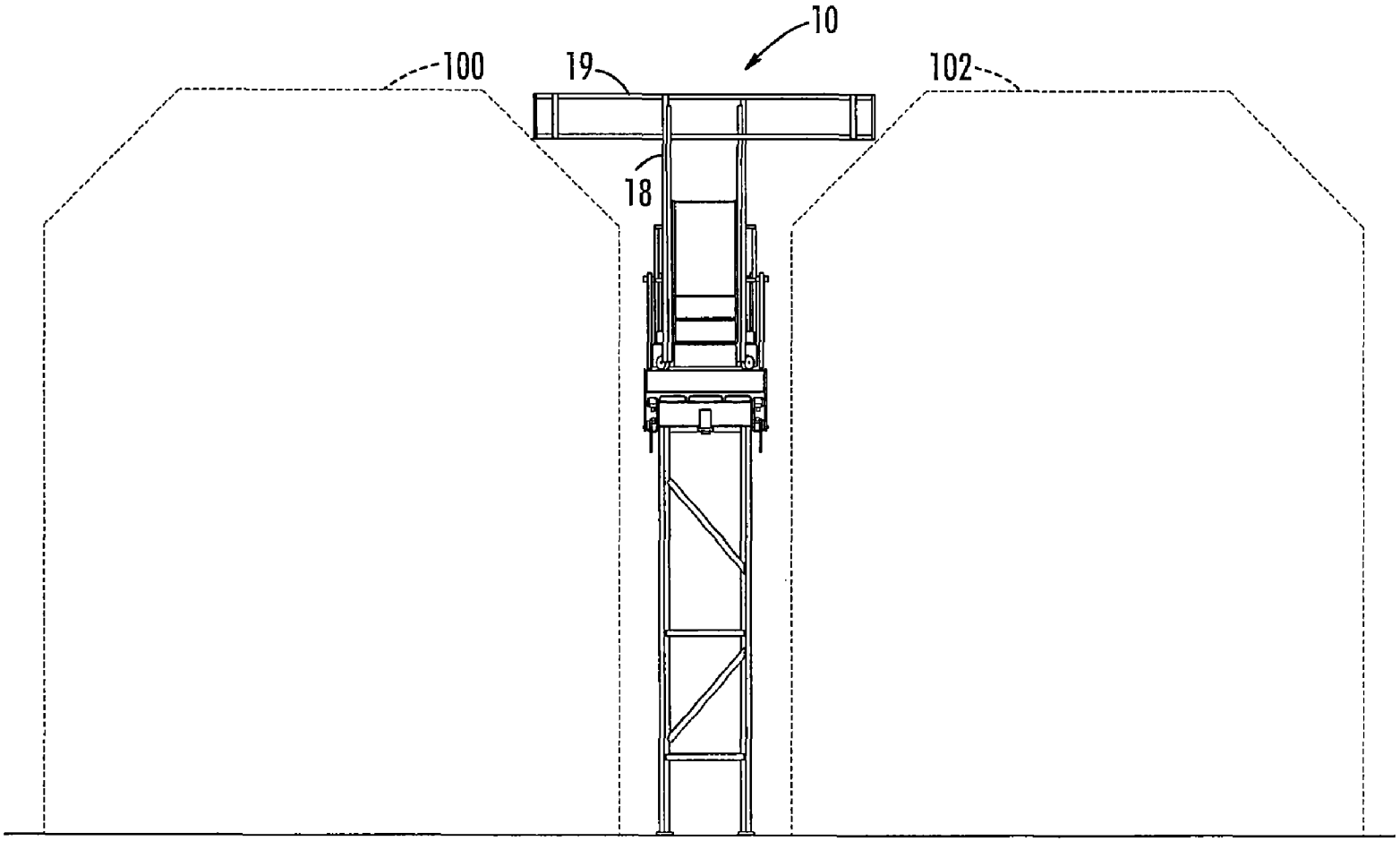
FIG. 7 is a view of one embodiment of the present invention in the retracted position, showing that it does not intrude into the clearance envelopes of the two adjacent railways.

FIGS. 6 and 7 show an access platform 70 of the prior art and the access platform 10 of the present invention, respectively, and each of their position with respect to clearance envelopes 100 and 102. The clearance envelopes 100 and 102, which are shown in FIGS. 6 and 7 with dashed lines, are the buffer zones around the railways into which trackside equipment cannot intrude. Clearance envelopes are defined by government regulation, the rail companies, or both. FIG. 6 shows that the cage 72 of the access platform 70 of the prior art, even when fully retracted, intrudes into clearance envelope 102. In contrast, the cage 19 of the access platform 10 of the present invention can be rotated and retracted (FIG. 7) such that it clears both of the two clearance envelopes 100 and 102.

Figure 8:
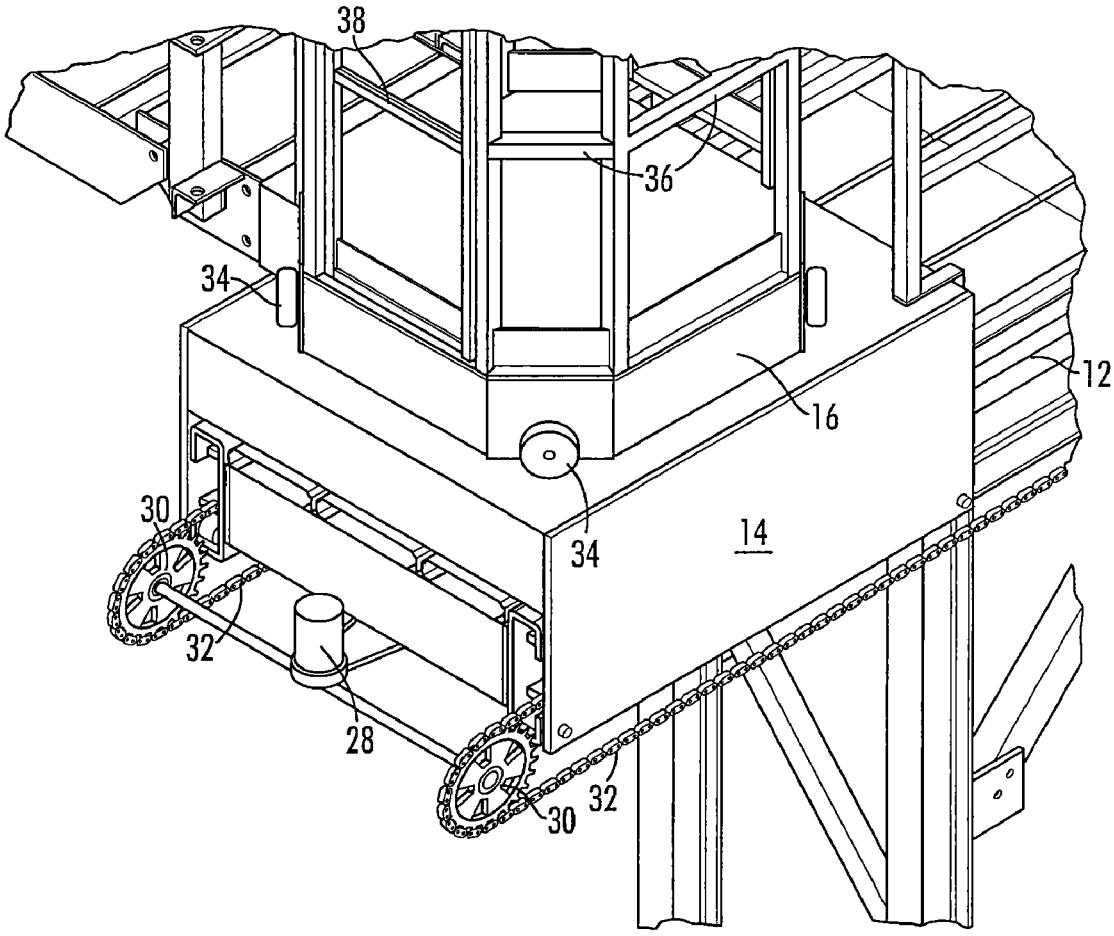
FIG. 8 is a perspective view of an embodiment of the present invention wherein the tracking platform can be moved electrically with a motor and chain.

FIG. 8 is a more detailed view of the tracking platform 14 and turret 16 of one embodiment of the present invention. The turret 16 is equipped with wheels 34 that bear on tracking platform 14 so that turret 16 can be rotated on tracking platform 14. When turret 16 is rotated on tracking platform 14, the wheels 34 follow a circular path on the top of tracking platform 14. FIG. 8 also shows an embodiment of the present invention in which the tracking platform 14 is moved along raised walkway 12 using an electric motor 28 coupled to sprockets 30. Sprockets 30 drive chains 32, which are connected to tracking platform 14 so that, when chains 32 are moved, tracking platform 14 moves along raised walkway 12. Alternatively, tracking platform 14 could be driven on raised walkway 12 pneumatically, hydraulically, or manually.

Figure 9:
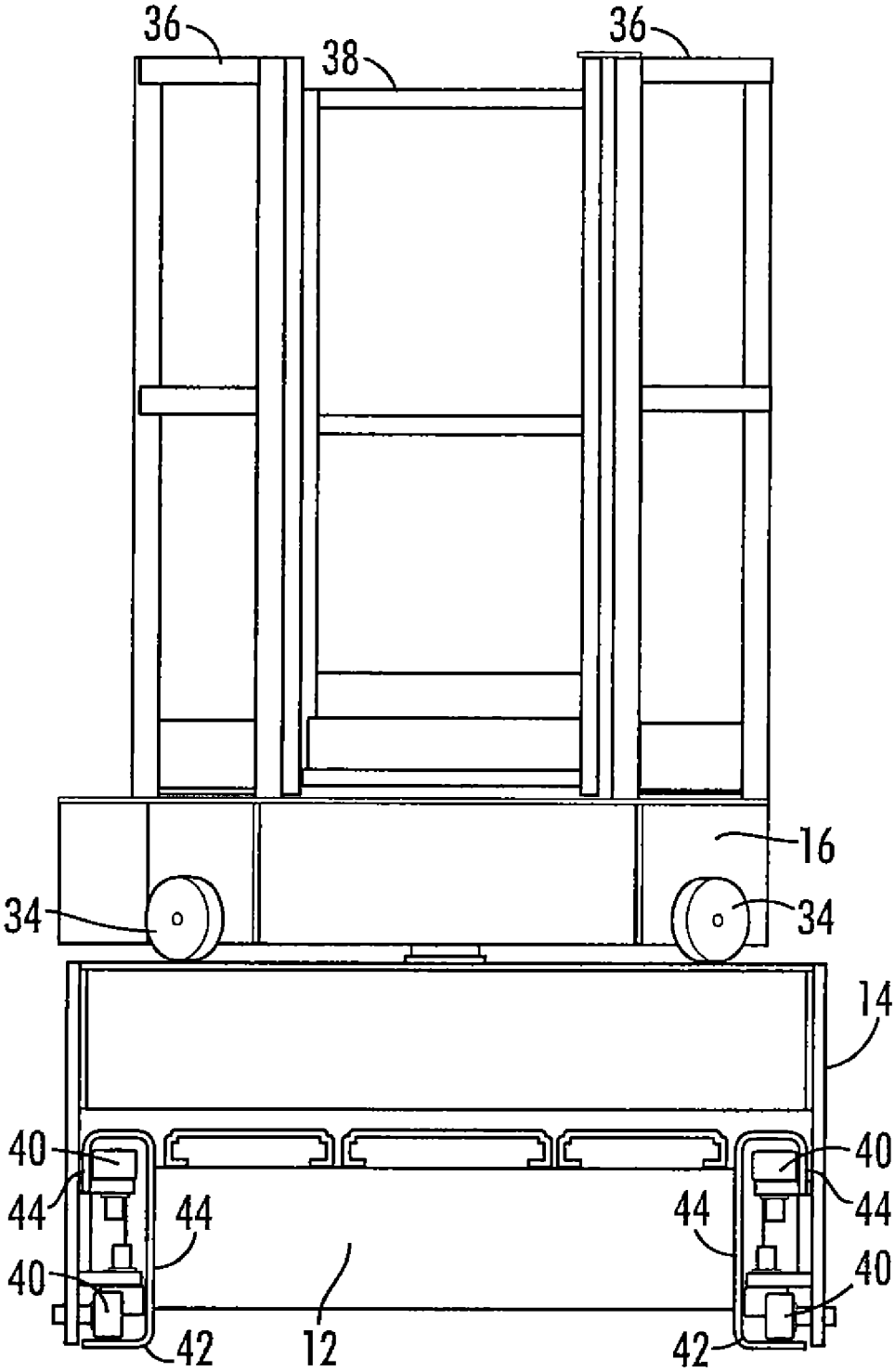
FIG. 9 is a detail view of one embodiment of the present invention wherein the tracking platform has rollers that bear on rails attached to the walkway.

FIG. 9 shows a detailed view of one embodiment of the present invention wherein the tracking platform 14 is equipped with rollers 40 and raised walkway 12 is equipped with tracks 42. The rollers 40 are dimensioned to be received and ride in tracks 42 so that tracking platform 14 can be moved on raised walkway 12. Furthermore, in this particular embodiment, the tracks 42 have sidewalls 44 that prevent the rollers 40 from moving off of tracks 42.

Those skilled in the art of designing access platforms will recognize that many substitutions and modifications can be made in the foregoing embodiments without departing from the spirit and scope of the present invention.

What is claimed is:

1. An apparatus for providing access to railcars on a pair of adjacent railways, each of said pair of adjacent railways having a clearance envelope, said apparatus positioned between said pair of adjacent railways and comprising:

a raised walkway, said walkway being substantially parallel to said pair of adjacent railways and having a length;

a tracking platform, said tracking platform carried by and longitudinally moveable along substantially all of said length of said walkway;

a turret pivotally attached to and carried on said tracking platform, said turret being able to pivot horizontally at least 180 degrees;

a bridge rotatably attached to said turret, said bridge being rotatable between a horizontal position and an upward vertical position thereby defining a vertical plane, said bridge being carried by said turret so that said bridge can be directed laterally toward said each of said pair of adjacent railways or longitudinally between and parallel to said pair of adjacent railways; and a cage rotatably attached to said bridge, said cage vertically rotatable so that said cage remains horizontal when said bridge is in said horizontal position and when said bridge is in said vertical position, said bridge and said cage dimensioned so that, when said turret is pivoted so that said bridge is directed longitudinally between said adjacent railways and said bridge is rotated to said upward vertical position, said bridge and said cage do not intrude into said clearance envelope of said each of said pair of adjacent railways.

2. The apparatus as recited in claim 1, wherein said tracking platform can be moved manually along said length of said walkway.

3. The apparatus of claim 1, said apparatus further comprising:

a plurality of load bearing wheels carried on said turret, said wheels affixed to and supporting said turret so that, when said turret pivots, said wheels roll thereby defining a circle.

4. The apparatus of claim 1, said apparatus further comprising:

a ladder, said ladder attached to said walkway to provide access to and from said walkway.

5. The apparatus of claim 1, said apparatus further comprising:

a stairway, said stairway attached to said walkway to provide access to and from said walkway.

6. The apparatus of claim 1, said apparatus further comprising:

at least one roller carried on said tracking platform;

at least one track carried longitudinally on said walkway, said track dimensioned to receive and support said at least one roller so that said tracking platform is movable on said walkway.

7. The apparatus of claim 6, wherein said at least one track further comprises:

at least one sidewall, said sidewall dimensioned so that said at least one roller cannot laterally escape said at least one track.

8. The apparatus as recited in claim 1, said apparatus further comprising:

means connected to said tracking platform and said walkway for moving said tracking platform along said length of said walkway.

9. The apparatus as recited in claim 8, wherein said moving means comprise:

a motor;

at least one sprocket connected to said motor; and at least one chain connected to said sprocket, said tracking platform, and said walkway so that, when said motor drives said sprocket and said chain, said tracking platform moves along said length of said walkway.

10. The apparatus as recited in claim 8, wherein said moving means are pneumatic.

11. The apparatus as recited in claim 8, wherein said moving means are hydraulic.

12. The apparatus of claim 1, said apparatus further comprising:

at least one fixed handrail, said handrail carried on said turret.

13. The apparatus of claim 12, said apparatus further comprising:

at least one gate, said at least one gate carried on said turret.

14. The apparatus of claim 13, wherein said at least one gate is self-closing.

15. The apparatus as recited in claim 1, said apparatus further comprising:

two handrails, said walkway carrying said two handrails.

16. The apparatus as recited in claim 15, wherein said two handrails are slidably carried on said walkway and fixed to said tracking platform so that, when said tracking platform moves on said walkway, said handrails move with said tracking platform.

17. The apparatus as recited in claim 16, said apparatus further comprising:

two handrail guides, said handrail guides fixed to said walkway and positioned and dimensioned so that, when said tracking platform moves toward said two handrail guides, said two handrail guides receive and support at least a portion of said two handrails.

18. The apparatus as recited in claim 17, wherein each of said two handrail guides further comprises:

a plurality of rollers positioned within said handrail guide, said plurality of rollers positioned and dimensioned to support at least a portion of each of said two handrails when said each of said two handrails is received into said each of said two handrail guides.

19. The apparatus as recited in claim 18, wherein said each of said two handrail guides further comprises:

at least one funneling tab, said at least one funneling tab positioned and dimensioned so that, when said each of said two handrails approaches said each of said two handrail guides, said at least one funneling tab directs said each of said two handrails into said each of said two handrail guides.

20. An apparatus for providing access to containers being moved on a pair of adjacent thoroughfares, each of said pair of adjacent thoroughfares having a clearance envelope, said apparatus positioned between said pair of adjacent thoroughfares on a raised walkway, said walkway having a length, said apparatus comprising:

a tracking platform, said tracking platform carried by and longitudinally moveable along substantially all of said length of said walkway;

a turret pivotally attached to and carried on said tracking platform, said turret being able to pivot horizontally at least 180 degrees;

a bridge rotatably attached to said turret, said bridge being rotatable between a horizontal position and an upward vertical position thereby defining a vertical plane, said bridge being carried by said turret so that said bridge can be directed laterally toward said each of said pair of adjacent thoroughfares or longitudinally between and parallel to said pair of adjacent thoroughfares; and a cage rotatably attached to said bridge, said cage vertically rotatable so that said cage remains horizontal when said bridge is in said horizontal position and when said bridge is in said vertical position, said bridge and said cage dimensioned so that, when said turret is pivoted so that said bridge is directed longitudinally between said adjacent thoroughfares and said bridge is rotated to said upward vertical position, said bridge and said cage do not intrude into said clearance envelope of said each of said pair of adjacent thoroughfares.

* * * * *